United States Patent [19]

Skousgaard

[11] 4,143,433

[45] Mar. 13, 1979

[54] WATER CLOSET

[76] Inventor: E. Chris Skousgaard, 314 N. Emerald Dr., Lake Arrowhead, Calif. 92352

[21] Appl. No.: 888,048

[22] Filed: Mar. 17, 1978

[51] Int. Cl.[2] ..... E03D 3/10; E03D 3/12

[52] U.S. Cl. ..... 4/354; 4/359; 4/366; 4/362

[58] Field of Search ..... 4/353, 354, 359, 362, 4/367, 366, 370

[56] References Cited

U.S. PATENT DOCUMENTS

| | | | |
|---|---|---|---|
| 2,957,181 | 10/1960 | Lamping | 4/354 |
| 3,124,809 | 3/1964 | Schmid | 4/354 |
| 3,397,408 | 8/1968 | Skousgaard | 4/359 |
| 3,628,195 | 12/1971 | Skousgaard | 4/354 |
| 3,677,294 | 7/1972 | Gibbs et al. | 4/354 |
| 3,817,286 | 6/1974 | Caron et al. | 4/354 |
| 3,817,489 | 6/1974 | Caron et al. | 4/359 |

*Primary Examiner*—Henry K. Artis

[57] ABSTRACT

A water closet of the tank type in which air is entrapped in the tank creating pressure to assist in expelling flushing water to a bowl during the flushing cycle. The flushing cycle is activated by a disc valve and piston connected to a domestic water supply for dislodging a float and valve from a valve seat. The water closet is constructed with a minimum of moving parts by employing a piston for dislodging the float which temporarily cuts off the flow of water to the bowl and utilizes the water pressure for returning the piston to the static position. The system also employs a vacuum breaker assembly having a ball in an angled pipe maintained by gravity against a seat in the flushing water line. The force of the water flowing into the bowl forces the ball from the seat during flushing. The ball returns to the seat by the force of gravity on the completion of flushing, preventing back pressure from any vacuum in the domestic water supply. If back pressure occurs before the ball seats, air is drawn through a vent pipe into the domestic water supply, preventing any siphoning from a bowl.

14 Claims, 4 Drawing Figures

WATER CLOSET

BACKGROUND OF THE INVENTION

This invention relates to water closets, and more particularly relates to an improved water closet utilizing a pressurized tank system having a minimum of moving parts.

With the advent and increasing concern for water conservation, the need for an efficient water closet using minimum water for efficient operation is evident. Such devices have been heretofore proposed, but have not been widely accepted because of the complexity of their construction. Such systems employ pressurized tanks to reduce the overall space required for the system while maintaining the same efficient operation. These systems are advantageous in that they require less water for flushing and produce efficient operation with a minimum of objectionable noise.

SUMMARY OF THE INVENTION

The purpose of the present invention is to provide an improved water closet which has a minimum of moving parts and provides efficient operation with a minimum waste of precious water.

The present invention is an improvement on U.S. Pat. Nos. 3,397,408, issued Aug. 20, 1968, and 3,628,195, issued on Dec. 21, 1972, to the same inventor of the device disclosed herein, and are incorporated herein by reference.

In those patents, there is illustrated a water closet in which air is trapped at the top of a tank and aids in expelling water into the bowl, along with the domestic water supply pressure during flushing operation. However, it was found that that device was not as efficient as possible because of its somewhat complex construction and the number of moving parts required to perform the flushing operation.

The present invention provides an improvement in which the number of moving parts is reduced to a minimum. In the improved device the domestic water supply is connected to the tank through a check valve and also to the piston through a disc valve. The disc valve operation is on the same principle and is similar to that disclosed in U.S. Pat. No. 3,614,057, issued to Louis Hospe on Oct. 19, 1971. The piston in the improved version is operated solely by the water pressure itself without the need for any type of biasing spring or complicated sealing arrangements. In the improved version the piston dislodges the float during the flushing operation, opening the valve as before when the plunger on the actuating disc valve is pushed. However, in the present invention, an extended shank on the piston closes off the flow path of water to the bowl temporarily until the float is completely dislodged from the valve seat. The pressure in the tank, as well as the pressure from the domestic water supply, is now applied to the end of the shank of the piston, closing off the flow passageway to the bowl. This pressure begins to force the piston back to the static condition opening up the flow passageway to the bowl to begin the flushing operation. The piston, which is initially operated by the domestic water supply pressure, slowly drifts back to its static position with water bleeding off around the piston into the bowl because of the imbalance of pressure between the tank and the domestic water supply pressure. The clearance around the piston head and cylinder wall is controlled to permit the pressure of the domestic water supply to initially drive the piston up to dislodge the float valve, thus slowly releasing the water by allowing it to bleed off around the piston as the flushing water forces it down.

Simultaneously water flows through the float valve opening into the bowl through a unique vacuum breaker assembly which is adaptable to any present water closet by being connected in the line between the tank and the bowl. The vacuum breaker operates by means of a gravity controlled ball resting on a valve seat in the path of the flushing water. The ball is retained in a tube angled slightly upward and is forced from its seat by the flushing water. As the float valve begins to recede and the flushing water reduces in volume, the ball by gravitational force returns to the seat, preventing a vacuum condition in the domestic water supply from drawing contaminated water from the bowl into the water supply. If the vacuum condition occurs prior to reseating of the ball, air to break the vacuum condition is allowed to flow through a vent or stand pipe around the ball into the domestic water pipes without creating any siphoning condition in the bowl. A grating in the tube containing the ball permits the flushing water to flow past the ball into the bowl.

It is one object of the present invention to provide an improved water closet having a minimum of moving parts.

Another object of the present invention is to provide a water closet having a flushing operation operated entirely by the domestic water supply pressure.

Another object of the present invention is to provide an improved water closet in which a piston for dislodging the float from its seat temporarily excludes water from the bowl, thus causing the piston to be returned to its static condition by the flushing water.

Still another object of the present invention is to provide and improved water closet having a unique vacuum breaker assembly.

Still another object of the present invention is to provide an improved water closet having an improved vacuum breaker in the form of a gravity-operated ball engaging a seat in the flow line of the flushing water.

These and other objects of the invention will become readily apparent from the following detailed description of the invention when considered in conjunction with the accompanying drawings wherein like reference numbers identify like parts throughout.

DETAILED DESCRIPTION OF THE PREFERRED EMBODIMENT

Figure 1:
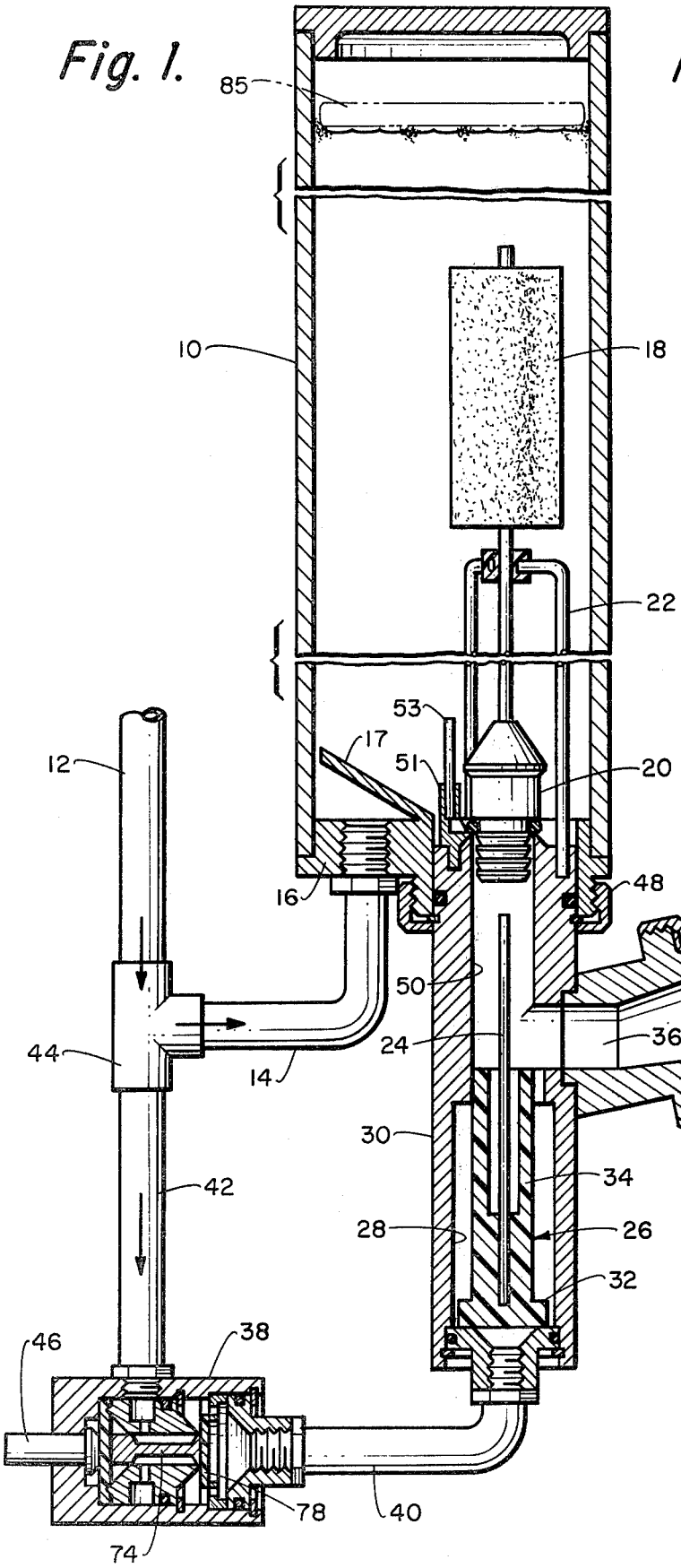
FIG. 1 is a sectional side elevation illustrating the invention in the static condition.
Figure 2:
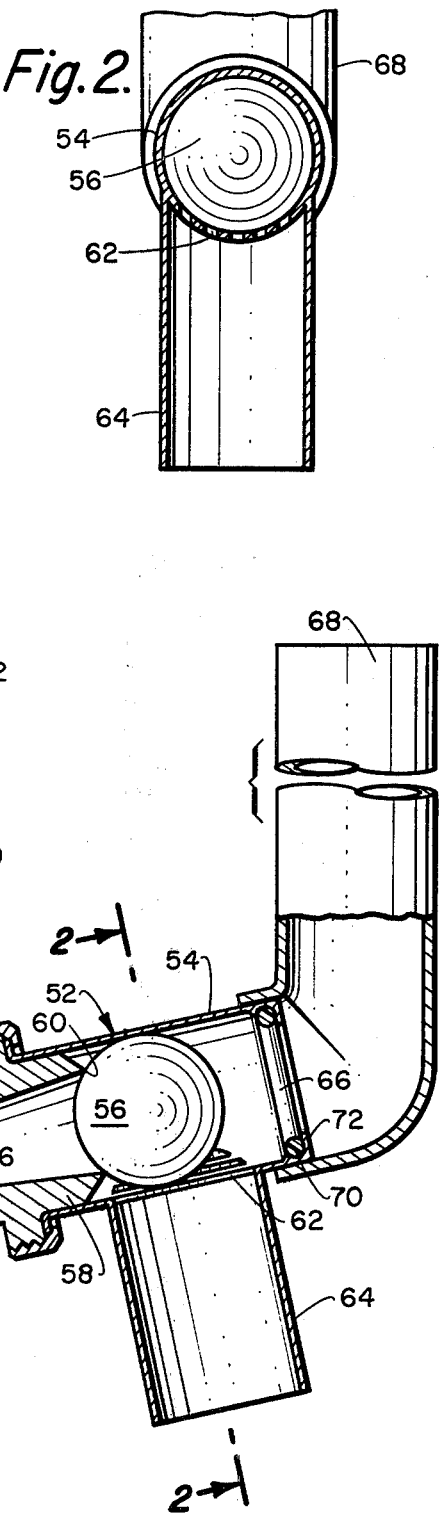
FIG. 2 is a sectional view of the vacuum breaker section of the invention taken at 2—2 of FIG. 1.

Referring now to the drawings, and in particular FIG. 1, there is shown a tank 10 closed at the top and bottom connected to a domestic water supply by means of line 12 through conduit 14 and an inlet in bottom plate 16. A deflector plate 17 adjacent to inlet in plate 16 acts as a turbulence arrestor to stop the water from "boiling" during filling of the tank 10. The plate 17

"smooths out" the flow of water into the tank in much the same manner as the baffle shown in U.S. Pat. No. 3,628,195, providing very quiet operation. The tank 10 has a float 18 for operating the float valve 20 in the usual manner. The float 18 is controlled by a cage or guide formed by rods 22.

The float valve 20 is operated and dislodged from its seat 80 by a rod 24 on the piston 26 retained in a cylinder or chamber 28 of a housing or casting 30. The piston has a piston head 32 and an elongate shank 34 for closing off outlet 36, as will be more clearly described hereinafter. The piston head 32 is slightly smaller than the diameter of the chamber 28 to allow water filling the chamber 28 to bleed off into the flushing system at a controlled rate, as will be more clearly described hereinafter.

The cylinder 28 is connected to a disc valve 38 by a conduit 40. The disc valve 38 is also connected to the domestic water supply 12 by another conduit 42 and a tee 44, and is operated by a plunger 46.

The piston housing 30 and float valve assembly is removably secured to the tank 10 by means of a coupling 48. Bore 50 in housing 30 provides a passageway from the tank 10 to the outlet 36 of a vacuum breaker 52.

The vacuum breaker 52 is comprised of a pipe or tube 54 attached to a fitting 58 secured to the housing 30. The tube 54 may be secured to the fitting 58 by any suitable means, such as a coupling or by welding or an adhesive. Inside the tube 54 is a ball 56 which normally rests against the seat 60 on the end of the fitting 58. The ball is retained in the tubing 54 by a grating 62 providing a passageway into the pipe 64 leading to a bowl. The pipe 54 has an opening 66 to permit air to flow around the ball when a suction or vacuum occurs in a domestic water supply 12 or in the tank 10. A vent tube 68 is secured by any suitable means to the end of the tube 54 holding the ball 56. An O-ring 70 pressed against lip 72 at the opening 66 in the end of tube or pipe 54 provides a seal when the ball 56 is forced to the end of the pipe 54 by flushing water.

The float bulb 20 is secured by a number of rods 22 forming a cage secured in the end of housing 30. Thus, removal of coupling 48 permits removal of the piston housing along with the cage 21 and float. The supply of air 84 at the top of tank 10 is regulated by a bleed tube fitting 51 seated in the end of housing 30, adjacent to the opening of chamber 50. A properly selected vent or air tube 53 is seated in the bleed tube 51 having its height arranged to expel excess air prior to seating of the float 20. That is, the height of air tube 53 is selected so that when the level of water in the tank falls below the end of the tube 53, excess air may bleed off through the tube into the mouth of the chamber 50 before the float 20 reseats. In this manner the amount of air 84 above the water level in tank 10 can be regulated.

Figure 3:
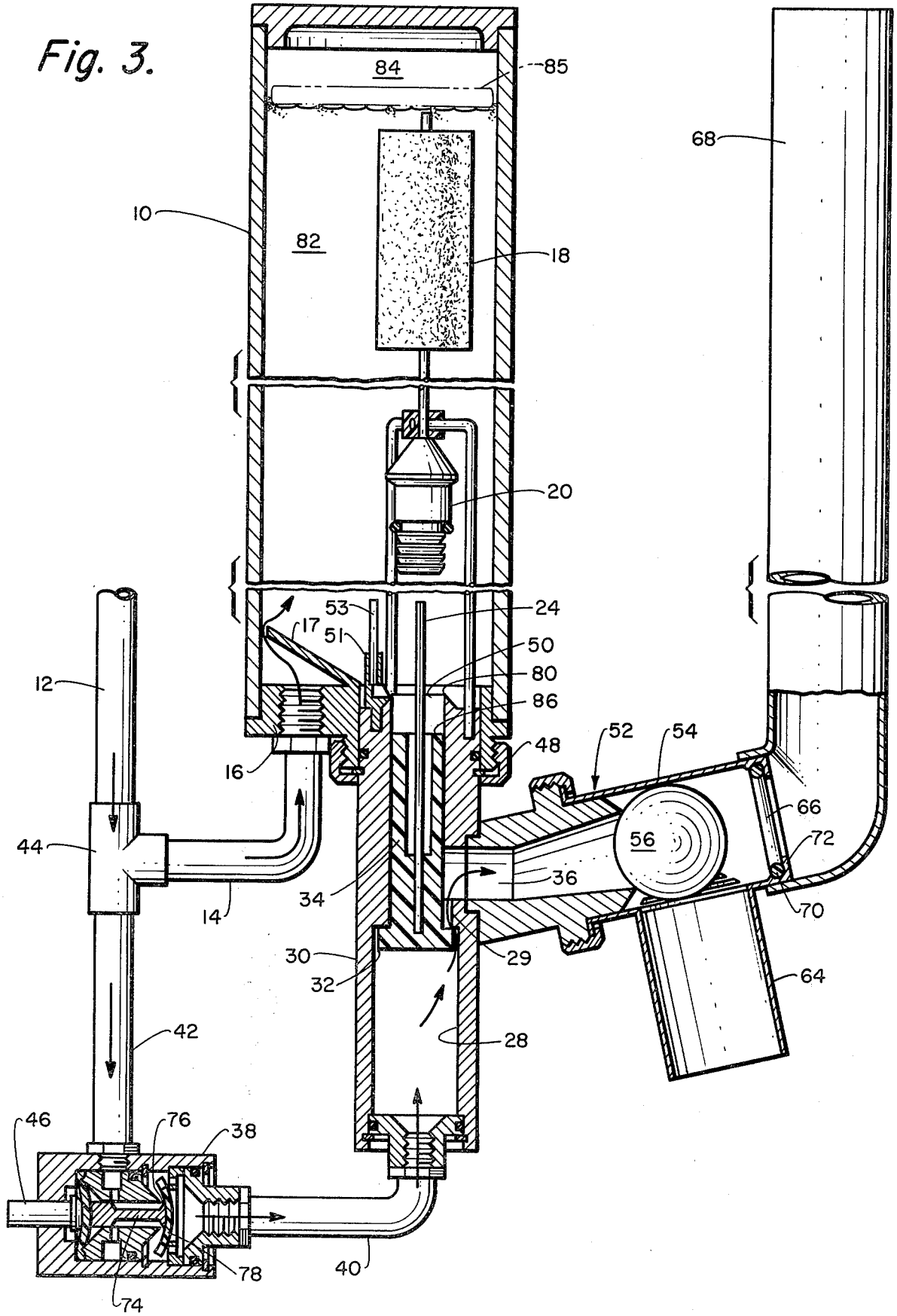
FIG. 3 is a sectional side elevation similar to FIG. 1 illustrating the invention immediately after actuation of the disc valve.
Figure 4:
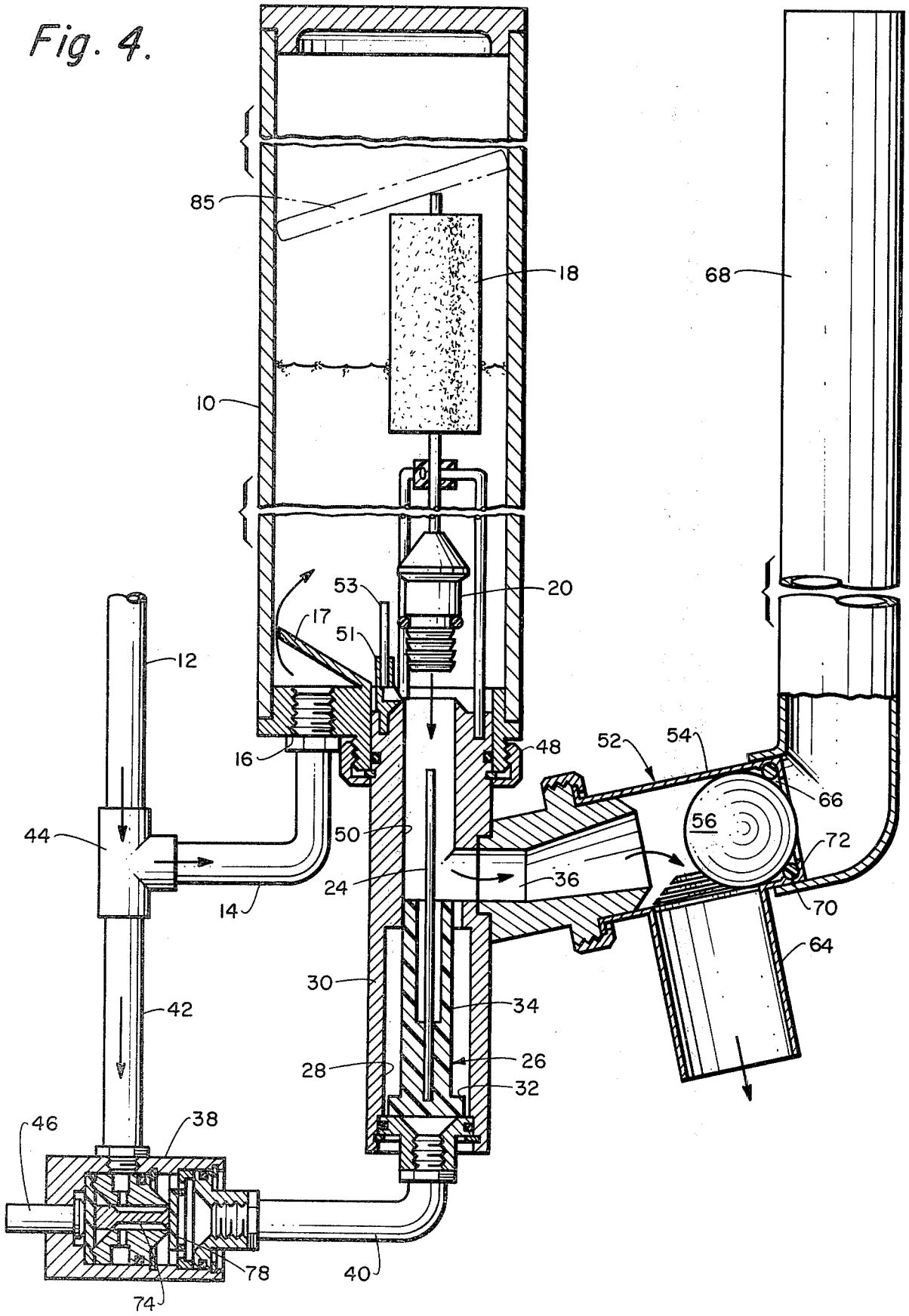
FIG. 4 is a sectional side elevation similar to FIG. 1 illustrating the invention in the flushing operation.

Operation of the system is substantially similar to that described in patent No. 3,397,408 referred to above and is illustrated in FIGS. 3 and 4. In FIG. 3 the operation of the system is depicted immediately after actuation of the disc valve 38 by pressing plunger 46. The pressing of plunger 46 forces the end of rod 74 away from the valve seat 76 against the action of the flexible disc 78 providing a flow of domestic water supply through the disc valve 38 into the chamber 28 through pipe 40. This action forces the piston 34 upward causing the rod 24 to dislodge the valve seal 20 from its seat 80. This permits water to flow into the bore 50 in the piston housing 30, but no flushing is permitted at this time as the shank 34 of the piston has closed off the outlet 36 to the bowl. When the piston reaches the limit of its travel (i.e. the end of chamber 28) with the chamber 28 full, the disc valve 38 automatically closes.

At this time the pressure from the water 82 and air 84 trapped in the tank 10, plus the pressure from the domestic water supply 12 through the deflector plate 17 on the bottom plate 16, is applied to the end 86 of the piston shank 34. This creates a pressure imbalance in which the pressure against the shank end of piston 26 exceeds the pressure at the opposite end on piston head 32, causing the piston to move downward in the chamber 28 until the outlet 36 is opened, as illustrated in FIG. 4. As the piston is forced downward water bleeds off around the piston head into the outlet 36. Indentation or cutout 29 adjacent to the outlet 36 provides a bleed path around piston head 32 when the piston is at the top of chamber 28.

Water immediately begins flowing through the outlet 36 through the tube 54 into the bowl through pipe 64. The force of the water forces the ball 56 in the vacuum breaker 62 against the O-ring seal 70, diverting substantially all of the flushing water into the bowl. Vent pipe 68 prevents any leakage of water which might flow around the ball 56 before it seals against the O-ring 70.

When the piston 26 reaches the bottom of the cylinder 28 and the float valve 18 closes, the pressure of the domestic water supply causes water to flow into the tank 10 to substantially fill the tank and create an air pressure head 84, returning the tank to the static condition illustrated in FIG. 1. The tank stops filling when the pressure in the tank equalizes with the pressure in the domestic water supply. No shut-off valve is needed.

The anti-siphoning or vacuum breaker 52 is unique in that it may be attached to any existing water closet by tapping into the supply line to the bowl with a fitting similar to 58. While fitting 58 is shown as secured or welded or otherwise fixed to the housing 30, it can be constructed for attachment in any number of ways. The vacuum breaker 54 allows the flow of water through outlet 36 into the bowl through pipe 64 by displacing the ball 56 to the end of the pipe 54 against the seal 70. The ball 56 remains in this position until the float valve sealing bulb 20 cuts off the flow of water to the bowl. At this time the ball rolls down the inclined tube 54 to reseat against the seat 60 of the fitting 58. If a vacuum should occur in the domestic water supply line 12 or tank 10 before the ball reseats, then air will be drawn through vent pipe 68 around the ball through the opening 66 and grating 62 into the domestic water supply, preventing any siphoning of water from the bowl through pipe 64. Alternatively, the ball 56 will be drawn tightly against the end of fitting 58 sealing off the water supply.

As described in U.S. Pat. No. 3,628,195, some means may be needed to compensate for absorption of air in the tank if the system is unused over an extended period of time. In most cases the domestic water supply is thoroughly aerated and no compensation is needed. However, one method of resupplying air would be to provide an aspirator in line 14 which would draw in a little air every time the tank is filled. Another method would be to float a buoyant disc 85 (shown in phantom) of styrofoam plastic or some other non-water-absorbing plastic, on top of the water in tank 10. Since the amount of absorption is directly proportional to the area of air-water interface, the float could reduce this area by better than 95%, thus reducing the air absorption. The sides of the float 85 would be suitably curved to prevent it from becoming wedged in the tank.

Thus there has been disclosed an improved water closet in which all moving parts have been reduced to a minimum by simplifying valves and eliminating the necessity for springs or complicated constructions. The system operates smoothly, quietly and with a minimum of water wasted.

Obviously, many modifications and variations of the present invention are possible in light of the above teachings. It is therefore to be understood that the full scope of the invention is not limited to the details disclosed herein but may be practiced otherwise than as specifically described.

What is claimed is:

1. A hydraulic flushing device comprising:
a tank having a closed upper end;
closing means closing the bottom end;
connecting means connecting said tank to a domestic water supply;
an outlet adjacent to the bottom of said tank;
a float normally closing said outlet;
a piston mounted below said outlet;
a valve connected to the domestic water supply;
a conduit from said valve to said piston to supply water under pressure to one side of said piston when said valve is activated;
dislodging means on said piston for dislodging said float when water is supplied to said piston; and
said piston adapted to close said outlet before said float is dislodged whereby water from said tank forces said piston back to its original position during the flushing operation to open said outlet.

2. The hydraulic flushing device according to claim 1, including:
an upwardly angled nipple connected to said outlet;
an upwardly angled tee coupled to said nipple;
a ball in the cross-member of said tee normally resting against the end of said nipple; and
said tee having its downward member connecting the cross-member to a toilet bowl, whereby water flowing through the nipple to the bowl pushes the ball off the seat and the angle of said tee and nipple causes the ball to roll back and seat against the end of the nipple after water stops flowing through the outlet.

3. The hydraulic flushing device according to claim 2 including:
grating means in the cross-member of the tee communicating with the downward member to prevent restriction of the downward member by the ball.

4. The hydraulic flushing device according to claim 2 wherein the end of the tee cross-member opposite the end coupled to the nipple includes,
vent means venting said nipple to the atmosphere; and
sealing means for sealing said vent means when water is flowing through said nipple to said toilet bowl.

5. The hydraulic flushing device according to claim 4 wherein,
said vent means comprises a stand pipe connecting the open end of said tee cross-member to the atmosphere; and
said sealing means includes a lip on the open end of the cross-member whereby said ball is forced against said lip by the flow of water.

6. The hydraulic flushing device according to claim 5 including:
a resilient ring in said cross-member abutting said lip whereby said ball compresses said ring against said lip to seal the open end of the cross-member during flow of water.

7. The hydraulic flushing device according to claim 1 wherein said dislodging means comprises:
an extension out of said piston adapted to engage and push said float off the seat after the piston closes the outlet.

8. The hydraulic flushing device according to claim 7 wherein said dislodging means comprises a rod of predetermined length attached to said piston.

9. The hydraulic flushing device according to claim 1 wherein said valve is an automatic closing flexible disc valve.

10. The hydraulic flushing device according to claim 1 wherein said piston comprises:
a cylinder in a sleeve;
a flange on the end of said cylinder opposite the dislodging means; and
a shoulder in said sleeve for abutment by said flange whereby the length of travel of said piston is limited.

11. The hydraulic flushing device according to claim 1 wherein:
said outlet intercepts said sleeve; and
said piston cylinder closes off said outlet when said flange is abutting said shoulder.

12. The hydraulic flushing device according to claim 1 including:
a float in said tank for reducing the air-water interface to reduce the absorption of air into the water.

13. The hydraulic flushing device according to claim 12 wherein said float is comprised of a non-water-absorbing plastic.

14. The hydraulic flushing device according to claim 13 wherein the float size is selected to reduce the air-water interface area by at least 95%.

* * * * *